United States Patent [19]

Egretier

[11] Patent Number: 4,828,397

[45] Date of Patent: May 9, 1989

[54] ROTARY, SELF-EMPTYING, CYLINDRICAL VATS

[76] Inventor: Jean-Michel Egretier, Domaine de Camplazans B.P. 301, 11103 Narbonne Cedex, France

[21] Appl. No.: 933,434

[22] Filed: Nov. 21, 1986

[30] Foreign Application Priority Data

Nov. 22, 1985 [FR] France ..... 85 17810

[51] Int. Cl.[4] ..... B01F 7/08

[52] U.S. Cl. ..... 366/184; 366/187; 99/277.2

[58] Field of Search ..... 366/184, 186, 187, 188; 99/277, 277.1, 277.2

[56] References Cited

U.S. PATENT DOCUMENTS 3,088,711 5/1963 Phillips ..... 366/187
3,147,956 9/1964 Phillips ..... 366/187
3,946,997 3/1976 Grenzebach ..... 99/277.2 X

FOREIGN PATENT DOCUMENTS 2811584 of 1979 Fed. Rep. of Germany .
2319546 of 1977 France .
2440326 of 1980 France .

*Primary Examiner*—Stuart S. Levy
*Assistant Examiner*—Steven M. du Bois
*Attorney, Agent, or Firm*—Sughrue, Mion, Zinn, Macpeak and Seas

[57] ABSTRACT

A cylindrical, rotary and self-emptying vat for mixing and extracting materials contained therein combines a removal gutter (5) with one or two peripheral pick-up helical slopes (6 and 4) depending on whether the vat is horizontal or not. A racking orifice (7) is situated in one of the end walls of the vat near its axis. The invention is applicable to vinification, salting or curing, etc., as a fermentation accelerator or as a mixer.

5 Claims, 2 Drawing Sheets

ROTARY, SELF-EMPTYING, CYLINDRICAL VATS

The present invention relates to improvements in rotary, self-emptying, cylindrical vats for mixing and then extracting the material contained therein.

BACKGROUND OF THE INVENTION

Vinification vats exist which are capable of being rotated and which include peripheral helical slopes or ramps intended firstly to break up and immerse the marc which forms during vinification, and secondly to extract the marc when vinification is over. Such vats include a door located:

near the periphery of the end of the vat (the Egretier type); or near the middle of the end off the vat (the CMMC type).

In both cases the helical slopes extend up to the racking orifice, but in the first case implementation is simple since the end of the vat bulges outwardly, while in the second case the end of the vat is frustoconical which makes it difficult to implement and also makes implementation of the helical ramp difficult.

Further, in the first case and as a function of the diameter of the vat, the marc is collected in a hopper of greater or lesser size since evacuation takes place during rotation over a fraction of a turn of the cylinder occupying a few tens of degrees.

However, in the second case, it takes a long time to empty the vat and this can lead to the marc becoming oxidized.

The main aim of the invention is to mitigate these various drawbacks by providing a fast extraction device (no oxidation), suitable for all kinds of vats (thereby saving money with flat or bulging ends), and using marc-collecting hoppers of small size (racking orifice near the axis of the vat).

SUMMARY OF THE INVENTION

In accordance with the present invention the improvements consist in combining a removal gutter with one or two helical pick-up slopes (depending on whether the vat is horizontal or not) with the racking orifice being situated in one of the ends of the vat and near to the axis thereof.

If the vat is sloping, then only one slope is required, on the outlet side of the removal gutter to move the marc upwardly towards the inlet end of the gutter.

If the vat is horizontal, then two slopes are required and suffice for moving the marc along the entire tubular zone of the vat.

BRIEF DESCRIPTION OF THE DRAWINGS

Embodiments of the invention are described by way of example with reference to the accompanying drawings, in which.

MORE DETAILED DESCRIPTION

Figure 1:
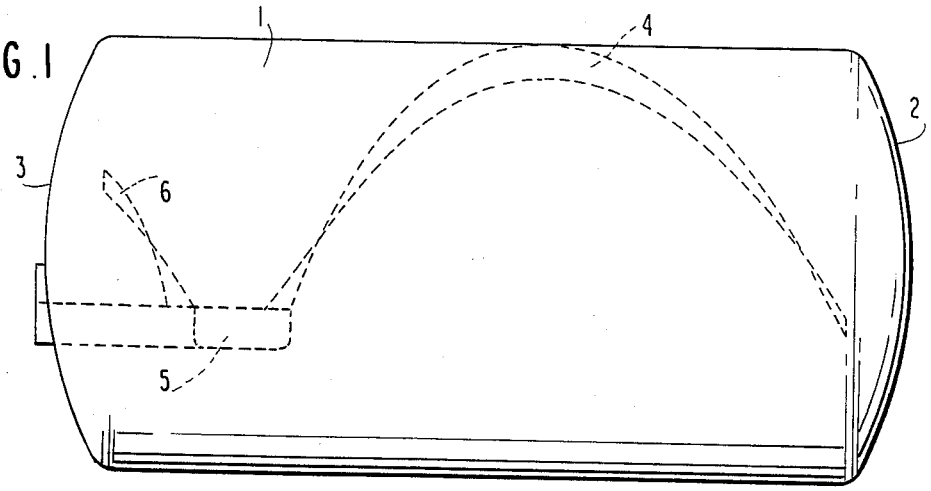
FIG. 1 is a side view of a vat in the horizontal position.
Figure 2:
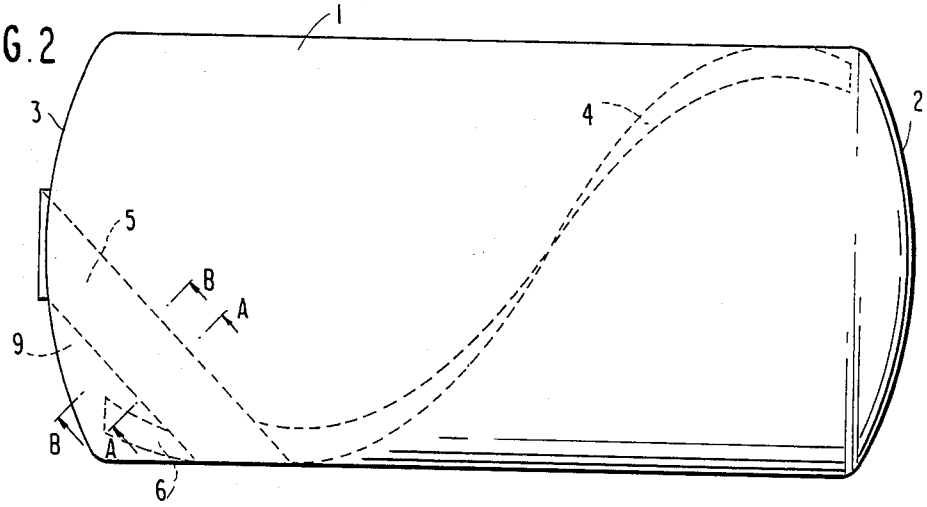
FIG. 2 is a plan view of the FIG. 1 vat.
Figure 3:
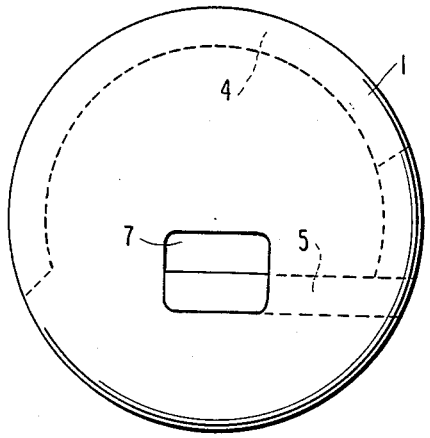
FIG. 3 is a front end view thereof.
Figure 4:
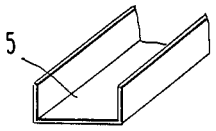
FIG. 4 is a fragmentary perspective view showing the shape of a symmetrical-sided gutter (section on AA)
Figure 5:
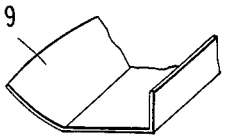
FIG. 5 is a fragmentary perspective view showing the shape of an asymmetrical-sided gutter (section on BB)
Figure 6:
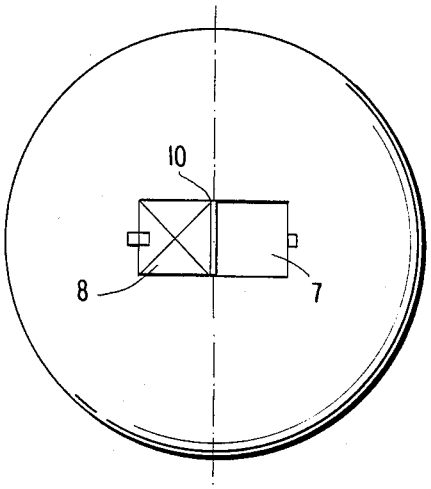
FIG. 6 shows a door whose hinges are centered on the axis of the vat.

The vat shown in the figures comprises:

a cylindrical tube 1;

a rear end 2 and a front end 3 both of which bulge outwardly from the vat;

a square opening 7 in the front end for emptying the vat; this opening may be centered on the axis of the vat or it may be offset therefrom;

a removal gutter 5 sloping between the opening 7 and the inside wall of the outer tube 1 and intended for receiving matter from front and back helical slopes 6 and 4 and removing it via the door 7. The gutter may have symmetrical sides as shown in FIG. 4 or else asymmetrical sides as shown in FIG. 5, in which case the gutter may be constituted by a section bar having a single side wall and having its opposite side connected to a sloping partition 9 which closes the corner gap existing between the gutter and the inside wall of the vat, thereby enabling the front helical slope 6 to be omitted. The gutter may be rectilinear or curved, and it may be level or on a slope;

the front peripheral helical slope 6 disposed between the front end 3 of the vat and the radially outer or tubular wall end of the gutter and running along the inside wall of the vat, said slope 6 being intended to pick up matter contained in the front zone of the vat and to drop said matter into the gutter 5 regardless of whether the vat is horizontal or sloping;

the back peripheral helical slope 4 disposed between the rear end 2 of the vat and the radially outer or tubular wall end of the gutter, said slope running along the inside wall of the tube and being intended to pick up matter contained in the rear zone of the vat and to drop said matter into the gutter 5. The rear helical slope 4 is intended for use with a vat whose axis is horizontal, since if the vat itself slopes slightly forwardly, then the rear helical slope 4 is not needed. The helical slopes 4 and 6 are oppositely handed to each other; and a lockable door or cover 8 which is movable and capable of closing the racking orifice 7. The cover may have a hinge 10 which is centered (as shown in FIG. 6) on the axis of the vat so that in the open position the ends of the door and the edges of the racking orifice rotate around the sme circumference.

It will readily be understood that such a vat is capable of picking up and removing any matter contained therein both rapidly and effectively, regardless of whether the vat is horizontal (having both helical slopes 4 and 6) or inclined (in which case it only needs the front helical slope 6).

Conventional items such as an emptying cock, a separating grille, a degassing device, means for rotating the vat, etc., have been omitted from the present description and drawings.

Naturally the invention is not limited to the embodiment described and shown, and numerous variants of the invention are possible without going beyond the scope of the claims, in particular the gutter may be of various other shapes, as may the racking orifice.

The invention is applicable to vinification, to salting or curing, etc., for accelerating fermentation or for mixing.

I claim:

1. A rotary, self-emptying, mixing and extracting apparatus, comprising:

(a) a cylindrical vat (1) having first (3) and second (2) opposite end faces and a horizontal axis, (b) a racking outlet (7) defined in a central portion of said first end face proximate said vat axis, (c) a single, substantially rectilinear discharge gutter (5) extending obliquely, in the manner of a bridge, between said racking outlet and a point on the inner wall of the vat cylinder spaced axially inwardly of said first end face, said discharge gutter having upstanding side walls extending over the full length thereof to channel and convey matter to be extracted along the gutter and to the racking outlet, (d) a first helical peripheral slope (6) unitary with the inner wall of the vat cylinder and extending between said first end face and the discharge gutter at said point on the inner wall of the vat cylinder, and (e) a second helical peripheral slope (4) unitary with the inner wall of the vat cylinder and extending between said second end face and the discharge gutter at said point on the inner wall of the vat cylinder.

2. An apparatus according to claim 1, wherein the entire vat cylinder between said first and second end faces is covered by said first and second helical slopes and said gutter.

3. An apparatus according to claim 2, wherein said first and second helical slopes are oppositely handed.

4. A rotary, self-emptying, mixing and extracting apparatus, comprising:

(a) a cylindrical vat (1) having first (3) and second (2) opposite end faces and a horizontal axis, (b) a racking outlet (7) defined in a central portion of said first end face proximate said vat axis, (c) a single, substantially rectilinear discharge gutter (5) extending obliquely, in the manner of a bridge, between said racking outlet and a point on the inner wall of the vat cylinder spaced axially inwardly of said first end face, said discharge gutter having an upstanding side wall extending over the full length thereof from an innermost edge of the gutter closest the vat axis to channel and convey matter to be extracted along the gutter and to the racking outlet, (d) a lateral partition (9) of the gutter extending radially outwardly from the racking outlet and axially outwardly from said point to close a triangular gap defined between the gutter, the first end face, and the vat cylinder between said point and the first end face, and (e) a helical peripheral slope (4) unitary with the inner wall of the vat cylinder and extending between said second end face and the discharge gutter at said point on the inner wall of the vat cylinder.

5. A rotary, self-emptying, mixing and extracting apparatus, comprising:

(a) a cylindrical vat (1) having first (3) and second (2) opposite end faces and an inclined axis, (b) a racking outlet (7) defined in a central portion of said first end face proximate said vat axis, (c) a single, substantially rectilinear discharge gutter (5) extending obliquely, in the manner of a bridge, between said racking outlet and a point on the inner wall of the vat cylinder spacing axially inwardly of said first end face, said discharge gutter having upstanding side walls extending over the full length thereof to channel and convey matter to be extracted along the gutter and to the racking outlet, and (d) a helical peripheral slope (6) unitary with the inner wall of the vat cylinder and extending between said first end face and the discharge gutter at said point on the inner wall of the vat cylinder.

* * * * *